United States Patent [19]

Briggs et al.

[11] 4,162,817

[45] Jul. 31, 1979

[54] ELECTRICAL CONNECTOR

[75] Inventors: Barry D. Briggs, New Concord; Ray L. Lawter, Zanesville, both of Ohio

[73] Assignee: NCR Corporation, Dayton, Ohio

[21] Appl. No.: 892,046

[22] Filed: Mar. 30, 1978

[51] Int. Cl.[2] ..... H01R 13/20

[52] U.S. Cl. ..... 339/75 MP; 24/255 R; 339/255 P

[58] Field of Search ..... 339/61 R, 61 C, 61 L, 339/61 M, 75 R, 75 M, 75 MP, 255 P, 260, 261; 24/255 SL, 137, 255 R

[56] References Cited

U.S. PATENT DOCUMENTS

| | | | |
|---|---|---|---|
| 3,602,870 | 8/1971 | Willard | 339/75 MP |
| 3,609,847 | 10/1971 | Engler | 24/137 R X |
| 3,616,497 | 11/1971 | Esposito, Jr. | 24/255 R X |
| 3,629,912 | 12/1971 | Klopp | 24/255 SL |
| 3,914,007 | 10/1975 | Seidler | 339/261 X |
| 4,040,697 | 8/1977 | Ramsay | 339/255 P X |
| 4,055,800 | 10/1977 | Fisk et al. | 339/75 P X |

OTHER PUBLICATIONS

"A Simple and Adaptable Form of Electrical Contact", by W. P. White, Scientific American, p. 140, Feb. 11, 1911.

*Primary Examiner*—William R. Briggs

*Attorney, Agent, or Firm*—J. T. Cavender; Wilbert Hawk, Jr.; Richard W. Lavin

[57] ABSTRACT

A low cost flexible connector for connecting multiple electrical conductors of an electrical component such as, for example, a gas discharge panel or flat flexible printed circuit harnesses, to associated conductors in a printed circuit board is disclosed in which the connector comprises a one-piece elongated plastic clamping member having lever portions joined at a fulcrum portion. Compression of the lever portions around the fulcrum portion opens a pair of jaw portions a distance sufficient to receive a printed circuit board and its associated conductors, together with the conductors of the electrical component. The lever portions are interconnected by an integral pressure portion which normally urges the lever portions in an outward direction to provide a constant clamping pressure between the electrical conductors of the circuit board and those of the electrical component. Several different embodiments of the pressure portion are disclosed.

8 Claims, 5 Drawing Figures

ELECTRICAL CONNECTOR

BACKGROUND OF THE INVENTION

The present invention relates to an improved electrical connector, and particularly, to a low-cost connector capable of applying constant pressure between a large number of electrical conductors of an electrical component and the conductors of a printed circuit board. Prior electrical connectors have been limited to the number of conductors that they are capable of connecting. Normally, the connectors of the prior art have been designed to connect flat, flexible cables to printed circuit boards. These connectors have been quite costly due to their complicated construction or the requirement of their use in a connecting system which requires other members to coact with the connecting member to provide their required connection. Examples of this type of connector are disclosed in U.S. Pat. Nos. 3,879,099, 4,018,496, 4,019,798 and 4,023,878. The coupling operation involving each of these connectors requires a setup procedure which includes the use of an interfacing device between the printed circuit board and the electrical conductors in the electrical members, thereby increasing the cost of the connectors.

SUMMARY OF THE INVENTION

It is therefore the principal object of this invention to provide a connector for connecting a plurality of electrical conductors of one component to associated conductors of a second component, such as, for example, a gas discharge display and a printed circuit board, which is simple in construction and therefore low in cost. It is another object of this invention to provide a connector which is easily mounted and demounted from engagement with the circuit board and the component. It is a further object of this invention to provide an electrical connector for connecting any size conductors or spacings of such conductors of an electrical component to a printed circuit board. In order to obtain these and other objects of the invention, there is provided an elongated connector formed of an elastic material having a pair of lever portions joined together at a fulcrum portion whose thickness allows the fulcrum portion to flex as the result of the movement of the lever portions towards each other, which flexing movement opens the end of the connector comprising a pair of jaw portions to accommodate the conductors of the electrical component and the conductors of the printed circuit board. The lever portions of the connector are interconnected by a pressure portion which is deformed upon movement of the lever portions towards each other, the deformation generating forces within the pressure portion urging the lever portions towards their original positions. Upon release of the lever portions, the deformed pressure portion returns to its original position thereby urging the jaw portions toward a closed position, thereby clamping the conductors of the electrical component to the conductors in the printed circuit board. There are disclosed several embodiments of the pressure portion which may be used to provide the necessary clamping forces.

BRIEF DESCRIPTION OF THE DRAWINGS

The foregoing and other objects, features and advantages of the invention will become apparent from the following preferred embodiment illustrated in the accompanying drawings of which.

DESCRIPTION OF THE PREFERRED EMBODIMENT

Figure 1:
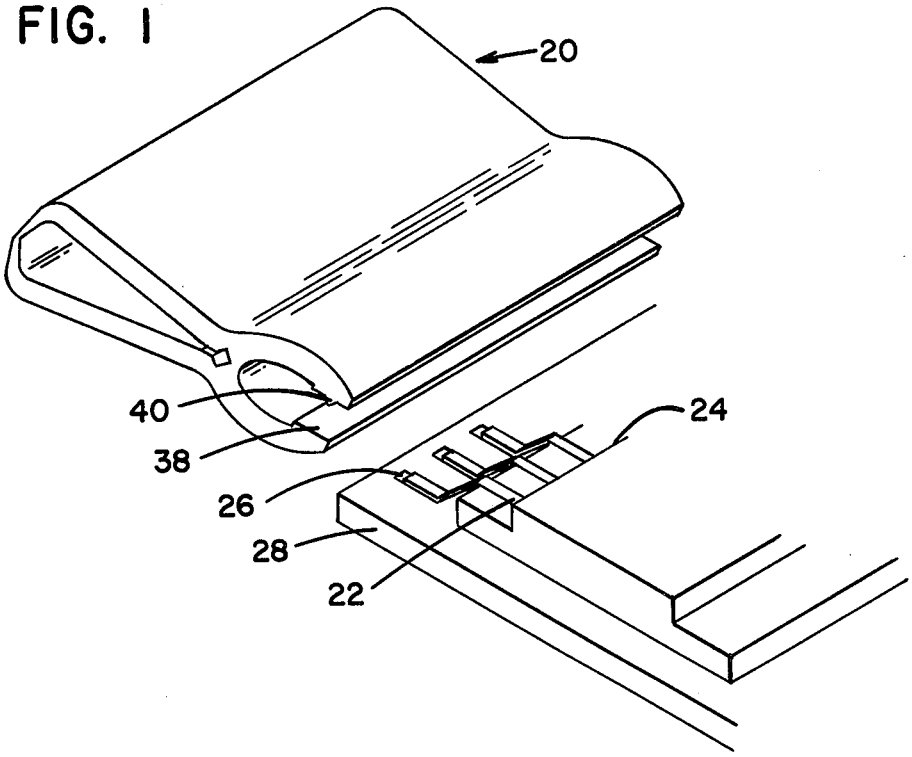
FIG. 1 is a perspective view of the electrical connector prior to engagement with the printed circuit board and the electrical conductors of a gas discharge display component.

The connector 20 of the present invention is shown in FIG. 1 prior to coupling a number of electrical conductors 22 of a gas discharge display 24 to conductors 26 embedded in a printed circuit board 28 in a manner that is well-known in the art. The gas discharge display 24 may have up to 100 conductors with the display having a width of up to 12 inches long. The connector 20 may be molded of a plastic material such as polypropylene or any other type of plastic material which can be compressed and still return to its nearly original configuration upon release of the compression forces.

Figure 2:
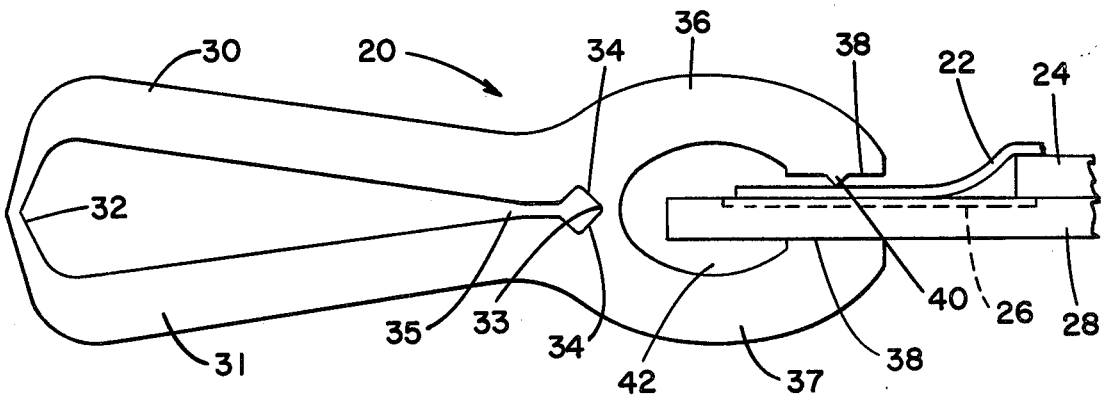
FIG. 2 is a side elevational view of the connector engaging the printed circuit board and the conductors of the gas discharge display.

As shown in FIG. 2, the connector 20 is formed with a pair of elongated lever portions 30 and 31 joined at one end by an outwardly extending pressure portion 32 which portion flexes outwardly upon movement of the lever portions 30 and 31 towards each other. The flexing of the pressure portion 32 outwardly generates forces within the pressure portion tending to restore it and move the lever portions 30 and 31 away from each other, thereby restoring the pressure portion 32 nearly to its unflexed position.

The other ends of the lever portions 30 and 31 are joined by a fulcrum portion 33 formed by a recessed portion 34 located in each of the lever portions 30 and 31. Located adjacent the fulcrum portion 33 is a slot portion 35 formed by adjacent spaced-apart edges of the lever portions 30 and 31, the width of the slot 35 being selected to control the length of inward movement of the lever portions 30 and 31 and therefore the amount of deformation that occurs in the pressure portion 32. As shown in FIG. 2, the lever portions 30 and 31 terminate in jaw portions 36 and 37 respectively, having opposed flat engaging surfaces 38 (FIGS. 1 and 2) for engaging and forcing the conductors 22 of the gas discharge display 24 (FIG. 1) into engagement with the conductors 26 embedded in the printed circuit board 28. As further shown in FIG. 2, the upper engaging surface 38 of the jaw portion 36 includes a pointed protrusion 40 extending lengthwise of the surface 38 for providing a concentrated force on the conductors 22 ensuring a more positive electrical contact between the conductors 22 and 26.

In operation, the lever portions 30 and 31 of the connector 20 will be squeezed together forcing the pressure portion 32 outwardly and opening the jaw portions 36, 37 to receive within an interior opening 42 formed by the jaw portions 36 and 37 the edge of the printed circuit board 28 together with the conductors 22 of the display 24. Prior to insertion within the opening 42, the conductors 22 and 26 will have been aligned. Upon release of the lever portions 30 and 31, the pressure portion 32 will attempt to return to its original configuration, forcing the jaw portions 36 and 37 of the connector 20 to move the conductors 22 of the display 24 into engagement with the conductors 26 of the printed circuit board 28. Since the thickness of the circuit board 28 will prevent the jaw portions 36 and 37 from returning to their home position, a constant pressure will be applied to the jaw portions 36 and 37 by the pressure portion 32 as the pressure portion is prevented by such engagement to return fully to its home or normal position. The pressure portion 32 thus remains in a flexed configuration until the connector 20 is removed from engagement with the printed circuit board 28.

Figure 3:
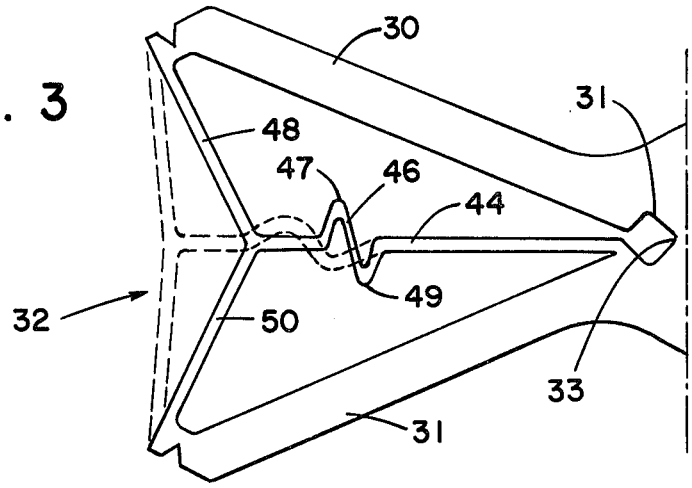
FIG. 3 is a side elevational view of a second embodiment of the pressure portion of the electrical connector.
Figure 5:
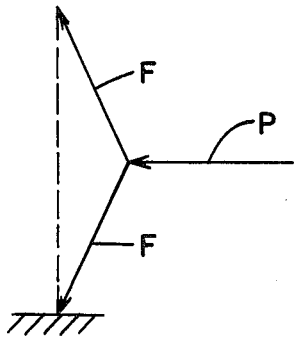
FIG. 5 is a force diagram of the pressure portion disclosed in FIG. 3.

Referring now to FIG. 3, there is shown a second embodiment of a pressure portion 32 which may be formed as part of the connector 20, the pressure portion 32 comprising a horizontally extending elongated arm portion 44 having one end terminating as part of the lever portion 31 of the connector 20. Formed as part of the arm portion 44 and located intermediate the ends of the arm portion 44 is a deformed portion 46 having a pair of off-set apex portions 47, 49, said deformed portion 46 orientated to collapse on itself when an axial load is applied inwardly on the arm portion 44. The other end of the arm portion 44 adjacent the deformed portion 46 terminates in a Y-shape arrangement comprising the arm portions 48 and 50 attached to the outer ends of the lever portions 30 and 31 respectively. In its normal position (shown in dotted lines in FIG. 3), the deformed portion 46 will provide a constant force on the arm portions 48 and 50, urging the arm portions to move in an outward direction. FIG. 5 illustrates a force diagram of this arrangement, wherein the deformed portion 46 exerts a force P at the junction of the arm portions 48 and 50 resulting in each of the arm portions 48, 50 exerting a force F on the lever portions 30 and 31, resulting in an outward movement of each of the lever portions 30 and 31. This outward movement of the lever portions 30 and 31 results in the jaw portions 36 and 37 moving inwardly towards a closed position. Movement of the lever portions 30 and 31 inwardly toward each other results in the deformed portion 46 being squeezed upon itself thereby allowing the junction of the arm portions 48 and 50 to move in an axial direction towards the fulcrum portion 33, shown in solid lines in FIG. 3. In this position, the deformed portion 46 will exert a constant pressure on the lever portions 30 and 31 to return such portions outwardly to their home position in the manner described previously.

Figure 4:
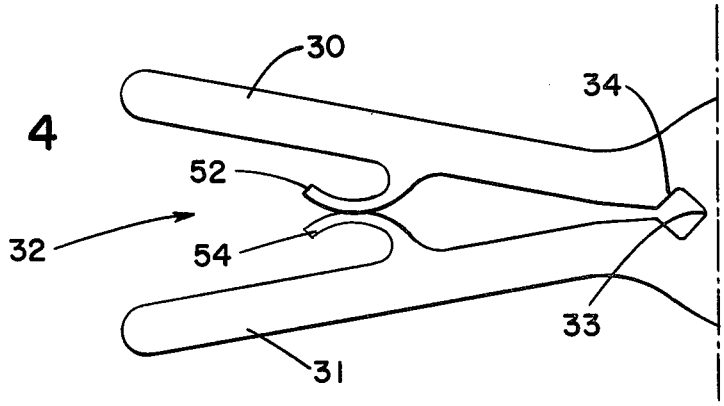
FIG. 4 is a side elevational view of a third embodiment of the pressure portion of the electrical connector.

Referring to FIG. 4, there is shown a third embodiment of the pressure portion 32 which comprises a pair of curved arm portions 52 and 54, each portion depending from the lever portions 30 and 31 respectively and so formed to engage each other thereby locating the lever portions 30 and 31 of the connector 20 in a home position. Upon movement of the lever portions 30 and 31 towards each other, the arm portions 52 and 54 will be compressed, resulting in the ends of the arm portions 52 and 54 slidably moving rearwardly and thereby exerting a constant outward pressure on the lever portions 30 and 31 to return to their home position.

It is obvious that each of the embodiments of the electrical connector disclosed in FIGS. 2, 3 and 4 provides a low-cost electrical connector which is of a one-piece molded or extruded plastic construction. Also, it is clear that such connector is capable of being cut to any width to hold any number of conductors of an electrical component in contact with electrical conductors in a printed circuit board. Due to the inherent deformation of the pressure portion 32 when the connector engages the electrical component and the printed circuit board, the connector provides a constant pressure on the conductors despite thickness tolerances insuring a more positive contact between the conductors of the printed circuit board and the component.

While the principles of the invention have now been made clear in the illustrated embodiments, it will be obvious to those skilled in the art that many modifications of structure, arrangements, elements and components can be made which are particularly adapted for specific environments and operating requirements without departing from these principles. The appended claims are therefore intended to cover any such modification, within the limits of the true spirit and scope of the invention.

What is claimed is:

1. A connector for coupling together the conductors of a plurality of electrical components comprising;

an elongated one piece body formed of a flexible electrical insulating material having a pair of jaw portions for clamping together the conductors of said components located therebetween;

a pair of spaced-apart lever portions each connected to one of said jaw portions and extending outwardly therefrom, each lever portion joined together adjacent said jaw portions forming a fulcrum portion for affecting the movement of its associated jaw portion upon the movement of the lever portions;

a first flexible portion interconnecting the ends of the lever portions;

and a second flexible portion secured to the first flexible portion intermediate its ends and the one piece body adjacent the fulcrum portion, said first and second flexible portions being moved to a deformed position upon the inward movement of said lever portions for constantly urging the lever portions to a position in which the jaw portions provide a clamping pressure on said conductors.

2. The connector of claim 1 in which said second flexible portion comprises:

a rearwardly extending arm portion having one end secured to one of said lever portions adjacent said fulcrum portion and having a collapsible deformed portion located intermediate its ends;

and said first flexible portion comprises a pair of inwardly orientated arm portions each interconnecting the outer end of one of said lever portions and the other end of said rearwardly extending arm portion for moving the other end of said rearwardly extending arm portion in a direction towards said fulcrum portion upon movement of the lever portions in an inward direction, said inward movement of the lever portions collapsing said deformed portion whereby the deformed portion will constantly urge the inwardly orientated arm portions and the lever portions in outward directions causing said jaw portions to clamp said conductors therebetween.

3. The connector of claim 2 in which the deformed portion is formed in an offset z-shaped configuration.

4. A connector for positioning a first electrical conductor of an electrical component in contact with a second electrical conductor in a substrate comprising;

an elongated one piece body member formed of a flexible plastic material, one end of which is comprised of a pair of co-planar spaced-apart jaw portions for receiving said first and second electrical conductors therebetween;

a pair of spaced-apart lever portions, each connected to one of said jaw portions and extending outwardly therefrom, the lever portions being joined adjacent said jaw portions to form a fulcrum portion for moving said jaw portions in response to the movement of said lever portions;

each of said lever portions having an engaging surface spaced one from the other adjacent said fulcrum portion for limiting the inward movement of said lever portions;

a first flexible portion interconnecting the ends of the lever portions;

and a second flexible portion secured to the first flexible portion intermediate its ends and one of said engaging surfaces, said first and second flexible portions being moved to a deformed position upon the inward movement of said lever portions for constantly urging the lever portions to a position in which the jaw portions provide a clamping pressure on said first and second electrical conductors.

5. The connector of claim 4 in which said second flexible portion comprises;

a rearwardly extending first arm portion secured to one of said lever portions adjacent said fulcrum portion and having a collapsible deformed portion located intermediate its ends;

and said first flexible portion comprises a pair of inwardly orientated second arm portions interconnecting the outward ends of said lever portions and the other end of said rearwardly extending first arm portion for moving the other end of said first arm portion in a direction toward said fulcrum portion upon movement of the lever portions in an inward direction, said inward movement of the lever portions collapsing said deformed portion whereby the deformed portion will constantly urge the second arm portions and the lever portions in an outward direction causing said jaw portions to maintain said first electrical conductor in contact with said second electrical conductor.

6. The connector of claim 5 in which said deformed portion is formed in an offset Z-shaped configuration having opposite apex portions around which the deformed portion collapses upon the inward movement of said lever portions.

7. A connector for positioning a plurality of side-by-side electrical conductors of a first electrical component in contact with aligned electrical conductors of a second electrical component comprising;

an elongated one piece body member formed of a flexible electrical insulating material having a pair of spaced-apart co-planar jaw portions for receiving said conductors therebetween;

a pair of spaced-apart lever portions each forming a rearward extension of said jaw portions, said lever portions joined together adjacent the rearward end of said jaw portions to form a fulcrum portion;

each of said lever portions including a recessed area positioned adjacent said fulcrum portion allowing said jaw portions to move in an outward direction upon the inward movement of said lever portions;

each of said lever portions further having oppositely located inner edge spaced a predetermined distance from each other adjacent said recessed area to limit the inward movement of said lever portions;

a horizontally extending first arm position secured to one of said inner edges having a Z-shaped collapsible deformed portion located intermediate its ends;

and a V-shaped second arm portion interconnecting the outward ends of said lever portions and the other end of said first arm portion for moving the other end of said first arm portion in a direction towards said fulcrum portion upon movement of the lever portions in an inward direction, said inward movement of the lever portions collapsing said deformed portion whereby the deformed portion will constantly urge the V-shaped second arm portion and the lever portions in a direction causing said jaw portions to provide a positive contact between the conductors of said first and second electrical components.

8. The connector of claim 7 in which said deformed portion is formed in an offset Z-shaped configuration having opposite apex portions around which the deformed portion collapses upon the inward movement of said lever portions.

* * * * *